US006378684B1

(12) United States Patent
Cox

(10) Patent No.: US 6,378,684 B1
(45) Date of Patent: Apr. 30, 2002

(54) DETECTING MECHANISM FOR A GROCERY CART AND THE LIKE AND SYSTEM

(76) Inventor: Gary L. Cox, 122 Brookhollow Dr., Evanston, WY (US) 82930

( * ) Notice: Subject to any disclaimer, the term of this patent is extended or adjusted under 35 U.S.C. 154(b) by 0 days.

(21) Appl. No.: 09/503,418

(22) Filed: Feb. 14, 2000

(51) Int. Cl.[7] ..... G07F 7/00
(52) U.S. Cl. ..... 194/213; 194/905
(58) Field of Search ..... 194/213, 905; 340/989, 990, 991, 992, 426, 568.1, 568.5, 825.49

(56) References Cited

U.S. PATENT DOCUMENTS

| | | | | |
|---|---|---|---|---|
| 2,964,140 A | | 12/1960 | Berezny | |
| 3,002,370 A | | 10/1961 | La Brie | |
| 3,029,905 A | | 4/1962 | Nowak | |
| 3,157,871 A | | 11/1964 | Umanoff | |
| 3,366,201 A | | 1/1968 | Pesta | |
| 3,394,945 A | | 7/1968 | Steier et al. | |
| 3,590,962 A | | 7/1971 | Parker et al. | 188/111 |
| 3,652,103 A | | 3/1972 | Higgs | 280/33.99 |
| 3,882,982 A | * | 5/1975 | Smith | 194/4 C |
| 3,892,295 A | | 7/1975 | Hahto | 188/111 |
| 3,897,863 A | * | 8/1975 | Peggs | 194/4 R |
| 4,242,668 A | | 12/1980 | Herzog | 340/539 |
| 4,424,893 A | * | 1/1984 | Gillet | 194/4 C |
| 4,524,985 A | | 6/1985 | Drake | 280/33.99 |
| 4,549,182 A | * | 10/1985 | Gillet | 340/942 |
| 4,572,347 A | | 2/1986 | Eisermann | 194/205 |
| 4,576,274 A | | 3/1986 | Thorsen | 194/210 |
| 4,591,175 A | | 5/1986 | Upton et al. | 280/33.99 |
| 4,609,075 A | | 9/1986 | Snedecker | 188/5 |
| 4,772,880 A | | 9/1988 | Goldstein et al. | 340/571 |
| 5,119,087 A | * | 6/1992 | Lucas | 340/825.35 |
| 5,194,844 A | | 3/1993 | Zeida | 340/426 |
| 5,283,550 A | | 2/1994 | MacIntyre | 340/539 |
| 5,295,064 A | * | 3/1994 | Malec et al. | 364/401 |
| 5,357,182 A | | 10/1994 | Wolfe et al. | 318/379 |
| 5,402,106 A | | 3/1995 | DiPaulo et al. | 340/572 |
| 5,432,412 A | | 7/1995 | Harris et al. | 318/3 |
| 5,485,006 A | | 1/1996 | Allen et al. | 250/222.1 |
| 5,540,316 A | | 7/1996 | DiPaolo et al. | 194/212 |
| 5,576,691 A | | 11/1996 | Coakley et al. | 340/568 |
| 5,598,144 A | | 1/1997 | Lace | 340/568 |
| 5,708,782 A | * | 1/1998 | Larson et al. | 395/214 |
| 6,024,203 A | * | 2/2000 | Amdahl et al. | 194/213 |
| 6,206,165 B1 | * | 3/2001 | Lenander | 194/213 |

* cited by examiner

*Primary Examiner*—Katherine A. Matecki
*Assistant Examiner*—Mark J. Beauchaine
(74) *Attorney, Agent, or Firm*—M. Reid Russell

(57) ABSTRACT

A shopping cart detection apparatus and reward dispensing mechanism for inclusion therewith for providing a patron reward in the form of a ticket, coupon, or the like, to a patron for their returning a shopping cart to a cart collection area. The shopping cart detection apparatus includes a control interface connected electrically to at least one sensor that senses proper cart passage through the apparatus into a cart collection area. With that passage to generate a radio frequency interrogation of a chip maintained in a card that is attached to the cart, and with that cart data transmitted to a control interface that directs dispensing of a ticket as a patron reward for their cart return. Additionally, the control interface also passes cart data as it receives to a communications interface that, in turn, passes that information to a computer, micro processor, or the like, for tabulating and maintaining information concerning cart usage. Which cart detection apparatus can be arranged as a portable or mobile unit for use on the parking lot of an establishment, and can be configured to operate as part of a cart retrieval system for locating carts as have been removed from the establishment premises. With, preferably, the patron reward system also includes a sensing apparatus to indicate to the establishment personnel when a roll of tickets as the dispenser utilizes is low and needs to be replaced.

19 Claims, 3 Drawing Sheets

DETECTING MECHANISM FOR A GROCERY CART AND THE LIKE AND SYSTEM

BACKGROUND OF THE INVENTION

1. Field of the Invention

A grocery cart detection mechanism and reward system where each grocery cart is equipped with an embedded chip that is read by a radio frequency control unit located in-store and/or in a store parking lot to keep track of cart use and provide a reward system to patrons for return of a cart to the store or to a designated cart storage area, and further allows for tracking cart movement and location utilizing a mobile unit.

2. Prior Art

The invention is in an electronic system for tracking, counting and locating shopping carts as are used in grocery or hardware stores or like commercial enterprises, and provides a reward and as an incentive for encouraging shoppers to return their carts into the store or to a designated cart storage location. Which incentive system also encourages a shopper to return to again shop at the commercial enterprise.

While electronic monitoring and locating systems for keeping track of shopping carts are certainly not new such have generally been directed to protecting shopping carts from theft and/or removal from the commercial enterprise premises to include cart wheel locking systems, alarms and the like. None, however, have involved the combination of a radio frequency detection and locating system in combination with a customer reward system that is like that of the invention.

Removal of shopping carts from their intended use area within and without a commercial enterprise has long been of great concern and their location and recovery has constituted a significant expense. Examples of wheel locking and disabling arrangements are found in a number of U.S. Patents. For example, patents to Lace, U.S. Pat. No. 5,598,144; to Oakley, et al., U.S. Pat. No. 5,576,691; to Harris et al., U.S. Pat. No. 5,432,412; to DiPaolo, et al., U.S. Pat. No. 5,402,106; to Wolfe, et al., U.S. Pat. No. 5,357,.182; to Moreno, U.S. Pat. No. 5,315,290; to Goldstein, et al., U.S. Pat. No. 4,772,880; and to Snedeker, U.S. Pat. No. 4,609,075, show only a few of a large number of patents concerned with prohibiting cart removal by providing electronic wheel locking and disabling systems. Electronic wheel locking systems, alarm systems for alerting store personnel to a removal of a cart from a controlled area are also shown in U.S. Patents to Maclntrye, U.S. Pat. No. 5,283,550 and to Zelda, U.S. Pat. No. 5,194,844, and cart dispensing systems are shown in a number of patents, for example, U.S. Patents to Dipaolo, et. Al., U.S. Pat. No. 5,540,316; to Allent et. Al., U.S. Pat. No. 5,485,006; to Parker, et. Al., U.S. Pat. No. 3,590,962 and to Steier et. Al., U.S. Pat. No. 3,394.945. None of which wheel braking or alarm system patents, however, have involved radio frequency operated remotely to provide for cart locating, monitoring and control systems that function with a customer reward system that rewards patrons for returning their carts to a designated area to both saving the enterprise money and to encourage return shopping.

Electronic sensing of cart movement in and out of a controlled area by sensing a carts metal mass is shown in a U.S. Patent to Thorsen, U.S. Pat. No. 4,576,274, and a U.S. Patent to Uager, U.S. Pat. No. 4,470,495 shows a utilization of a photo diodes for sensing cart travel through a light beam. Unlike these arrangement, the invention utilizes an active radio transmitter that interrogates a chip mounted onto a cart, preferably as part of a placard that is secured onto the cart side and contain individual cart information to provide for monitoring cart use and for scheduling maintenance, as well as for locating the cart by an interrogation system if it is removed from the premises. This cart information gathering and analysis capability of the invention is additional to its primary object of providing a reward to customers for their return of a cart to an identified area within or without the commercial or retail establishment. Accordingly, while devices that provide for active radio monitoring of cart location are shown in U.S. Patents to Havens, U.S. Pat. No. 4,868,544 and to Umanoff, U.S. Pat. No. 3,157,871, such have been for cart locating and retrieval only and have not included nor provided a reward system for cart return. Further, while trolley or cart return reward systems are shown in two U.S. Patents to Gillet, U.S. Pat. Nos. 4,424,393 and 4,549,182 and in a U.S. Patent to Eisermann, U.S. Pat. No. 4,572,347, these reward systems do not provide the simple, yet versatile, electronic sensing, command and control system like that of the invention for use with an accurate and reliable client reward system.

SUMMARY OF THE INVENTION

It is a principal object of the present invention to provide a shopping cart detection apparatus and patron reward system for sensing and identifying a shopping cart return to a cart collection station that will electronically log in the cart and award a ticket, coupon, or the like, as a patron reward for returning the cart.

Another object of the present invention is to provide a shopping cart detection apparatus and patron reward system that includes at least one or more radio frequency control units located in or adjacent to a commercial establishment, the control unit or units each to send out an interrogation signal to a receiver unit on the cart consisting of a chip embedded inside a placard, or the like, attached to a shopping cart to identify and record the individual cart identification, keeping a running inventory of cart use for scheduling maintenance, and to alert the merchant if cart has not been returned.

Another object of the present invention is to provide a shopping cart detection apparatus and patron reward system where low and high power reader units are provided, with a low power unit located in an installation that a cart entering a cart collection area passes closely by, for reading the individual cart identification for activating the patron reward, and with a higher power unit functioning as a long range receiver located proximate to a store entrance to read individual identifications of cart exiting the establishment to collect cart inventory data.

Another object of the present invention is to provide a shopping cart detection system that is capable of detecting the direction of cart travel out of or into a cart depository located on a cart owners premises and verifying that the direction of cart return is proper to warrant issuance of a reward to that patron for a cart return in the form of a ticket, or the like, and prohibiting such award when the cart is not being returned from a bonafide use.

Still another object of the present invention is to provide, with a shopping cart detection system, a cart mounted receiver unit that, when used with a close proximity radio frequency reader unit does not require a power source to respond to an interrogation signal generated by a control unit to provide to the control unit, location, service, and status information for cart control and to operate the patron reward system, but can include a power source, such as a long life lithium type battery, where a longer range cart sensing is required such as to locate a cart as has been removed from the establishment premises.

Still another object of the present invention is to provide a shopping cart detection system that is simple and relatively inexpensive to install and will reliably provide data for shopping cart inventory control, cart location information, as well as, cart usage data for use in planned cart service and maintenance, that is used with a customer reward system whereby, for the reward, a customer is encouraged to return a cart to a drop-off location in a cart owner's establishment or on their premises to receive a ticket, or the like, giving the shopper something of value for their cooperation and to encourage them to return to the establishment and shop.

The shopping at detection apparatus of the invention includes at least one radio frequency control unit that can be installed within or without a commercial establishment and is connected to a standard power source, or, if the control unit is located in a parking lot of that establishment, is battery or solar powered, and can either be fixed or portable. The control unit or units, also identified as control interface is to interrogate a receiver unit that is preferably a chip that is embedded in a placard, or the like, that is attached to a shopping cart. The control unit may be low power to operate in proximity to the receiver unit as when the can is pushed by the control unit in a cart collection area, or may be higher power to provide for an interrogation of carts as they leave the establishment for maintaining cart inventory control, with the control unit or units to transmit individual cart data as receiver from its interrogation of the receiver unit to an interface that is linked, for example, to a computer or on board micro processor. Cart data, such as location, use history, and the like, is thereby provided for use in planing cart preventative maintenance, repair and/or replacement or relocation, and, of course, for directing the awarding of incentives, such as a ticket, coupon, or the like, to the person bringing the cart to a return area on the premises. Further, using a portable control unit as, for example, a unit transmitting from a vehicle that searches for lost and misplaced carts, can send an interrogation signal to a receiver unit of such cart that, upon receipt of the interrogation signal, can respond to provide a signal to the portable unit for locating that cart. To facilitate such cart location, the cart can include a signaling arrangement, such as a flashing light, audio signal, or the like to alert the mobile control unit operator to the presence of a cart and to lead that operator to the cart. With the portable control unit itself provided with an alarm arrangement for alerting the vehicle operator of a near proximity to such cart. While the receiver unit does not require a power source to respond to an interrogation signal delivered from a control unit in near proximity thereto, when such control unit is not in close proximity, to allow the receiver unit to signal its presence, a power source, such as a lithium type battery, or the like, may be included with the receiver unit. The control unit can employ, as its sensing component, a single reader module that can sense a cart passing across or through a sensor barrier, and such sensor barrier may be a sensor generating a radio frequency signal, with cart passage to activate a reader module or unit that then interrogates the receiver unit as by transmitting a radio frequency signal that the receiver unit responds to by transmitting individual cart information to include the cart identification. This information is then passed by the reader module though a control interface and to a communications interface that can be a computer, micro processor, or the like. The reader module can be a pair of sensors each generating a beam, such as an infra red beam, where, to provide an interrogation and counting signal, a first sensor beam must be broken followed by a second sensor beam to prove out a proper direction of cart passage into a car return area, thereby precluding a cart from being counted should it be pulled back out of that cart return area. To further provide for a counting of carts as are legitimately returned before awarding a ticket, coupon, or like reward, to the person returning the cart, a timer or timing circuit may be employed with the control interface that must "time out" for the control interface to credit a cart return as legitimate, and provide a reward.

With the shopping cad detection and reward system of the invention, by a placement of sensors having a longer range capability than be the proximity sensors of the reader module on establishment exits, the establishment can determine and keep a running inventory total of the number of carts that are in the establishment and on the establishment parking lot to help to determine when an employee or employees need to retrieve carts from that lot. To insure that shoppers entering the establishment will have a cart available to them. The invention further facilitates the maintaining of an accurate cart inventory, giving an establishment management data as to the number of carts as are actually used, providing data with which to forecast the number of carts as are needed on particular days and even time of day, and to alert the merchant when and which carts are missing.

DESCRIPTION OF THE DRAWINGS

In the drawings that illustrate that which is presently regarded as the best mode for carrying out the invention.

DETAILED DESCRIPTION

Figure 1:
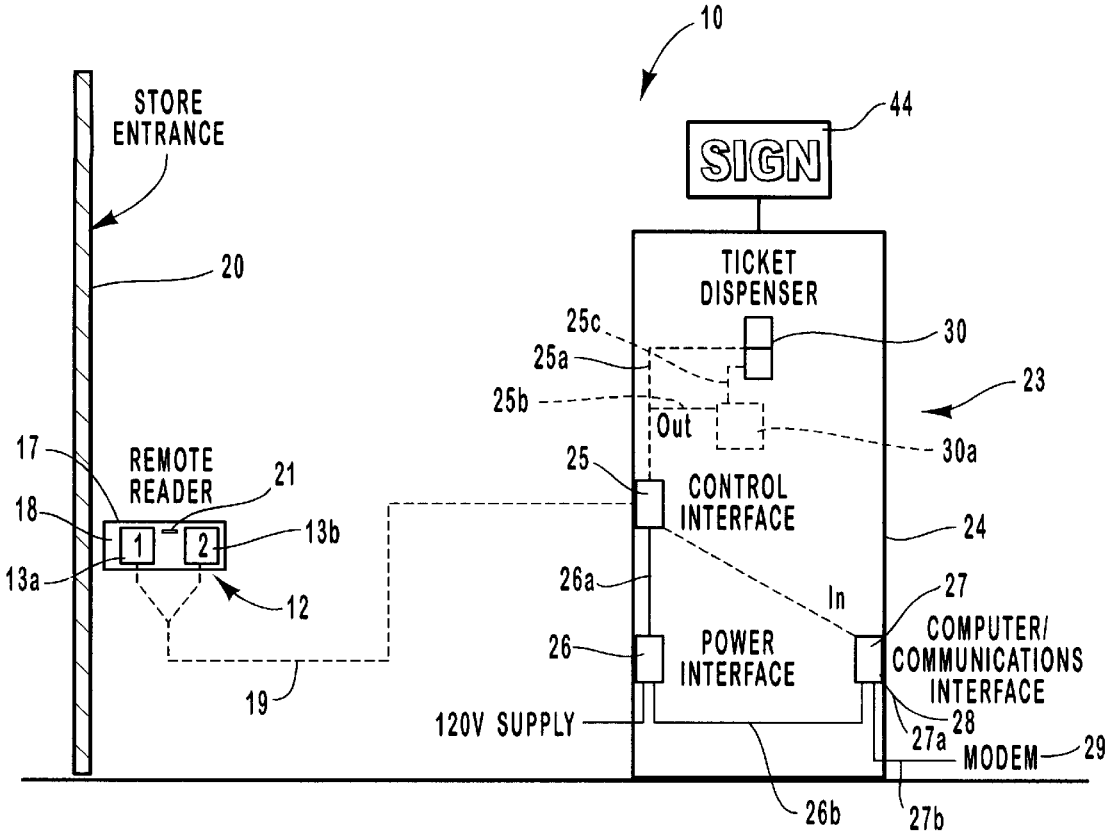
FIG. 1 is a profile schematic view of a shopping cart aligned to move across a remote reader unit of a shopping cart detection system of the invention that includes module containing a power source connected to a control interface that is electrically connected to both a remote computer, to receive cart data and to a ticket dispenser of a patron reward system.
Figure 2:
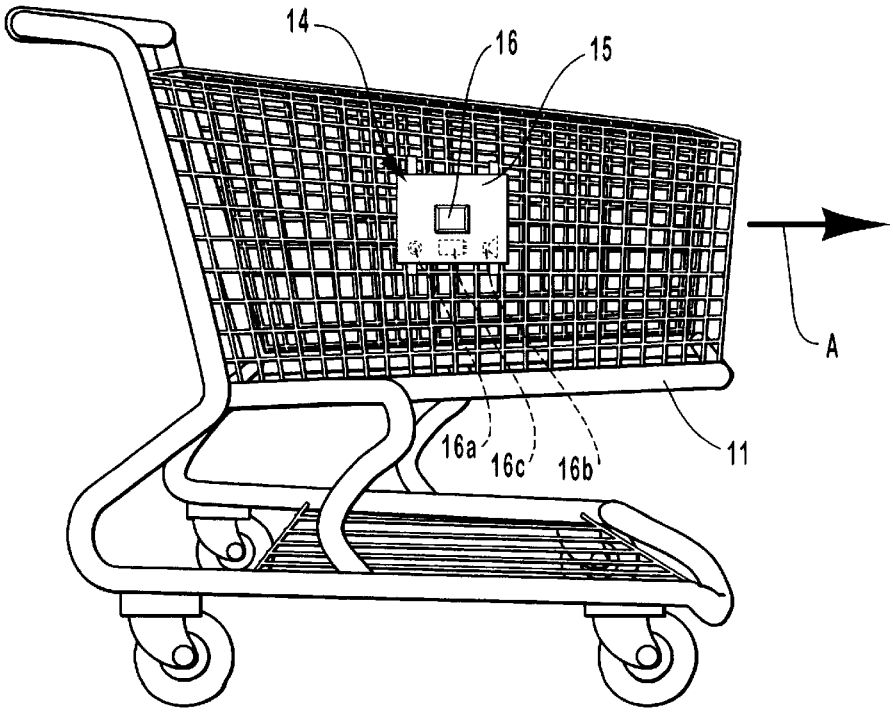
FIG. 2 is a side elevation view of a shopping cart showing a placard mounted onto a side thereof that has a receiver unit chip embedded therein.
Figure 4:
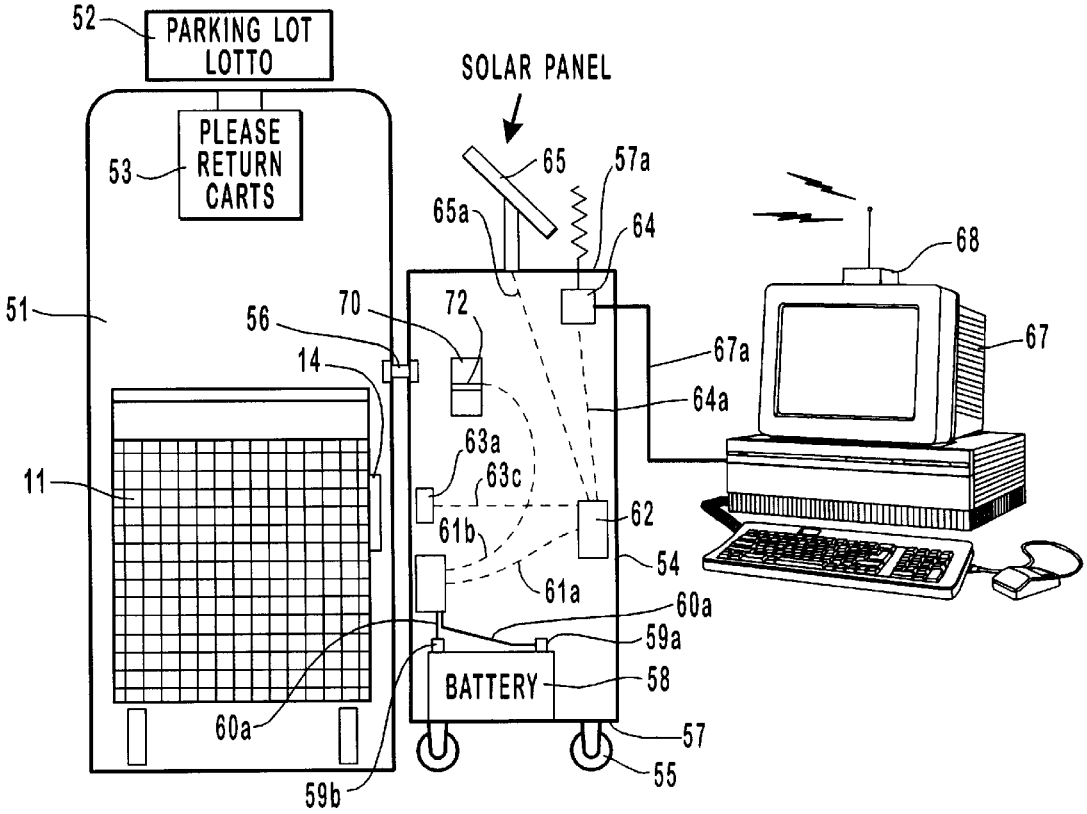
FIG. 4 is an end schematic view of a shopping cart aligned to pass sensors of a reader module of a portable shopping cart detection system of the invention that includes a battery power source connected for recharging by a solar panel, and includes a control interface that is electrically connected to both transmit cart information to a computer and to a ticket dispenser of a patron reward system.
Figure 5:
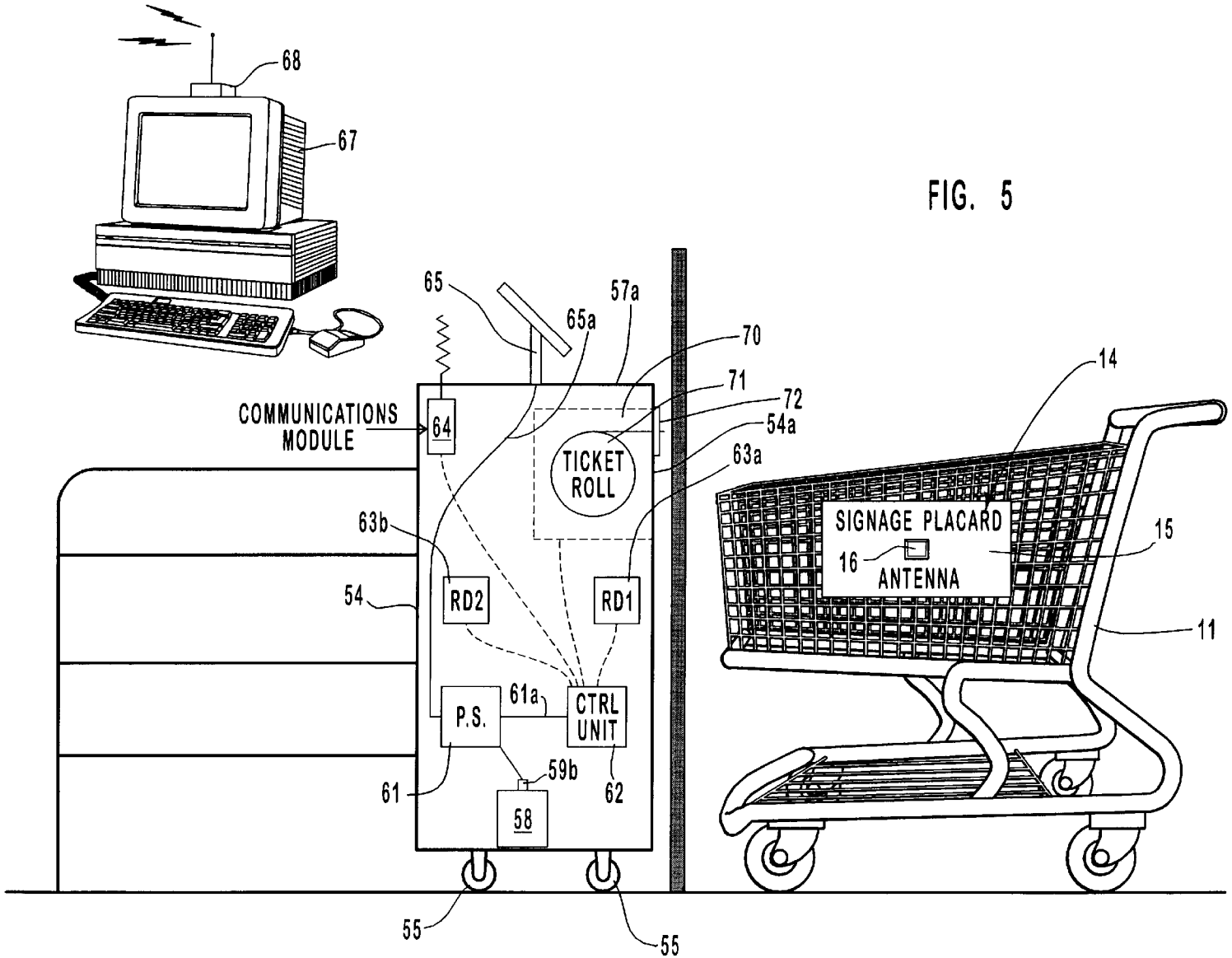
FIG. 5 is a side elevation schematic view of the cart and the portable shopping cart detection system of FIG. 4.

FIG. 1 shows a profile schematic view of a first embodiment of a shopping cart detection system 10 of the invention, and showing a shopping cart 11 in FIG. 2 for use with the invention that, it should be understood, is to be aligned to be moved, as shown by arrow A, across sensors 13*a*, identified as 1, and 13*b*, identified as 2, of a reader module 12 of FIG. 1 that is a remote unit. The shopping cart 11 includes a receiver unit 14, shown as a placard 15 mounted onto the cart 11 side that includes a chip 16 maintained on or within the placard. The placard 15 can be mounted to either cart 11 side and may have advertising materials printed thereon. The remote reader module 12, as shown in FIG. 1, includes a housing 17 that is maintained along an edge 18 of a wall 20 that represents a store entrance. The reader module 12 is preferably hard wired through line 19, shown as a broken line, to control interface 25 of a reward center module 23 that is located within the store. Alternatively, as shown in FIGS. 4 and 5, the reader module 12 can transmit, as radio frequency data, information as it reads from the receiver unit 14 to a reward center 50 via an antenna 64 and to a remote computer 67 that receives the transmission through antenna 68.

A preferred reader module is a stand-alone reader having a capability to generate a radio frequency signal to interrogate a proximity card and to receive a response from that card that includes a cart identification and other information as required. For the invention, a reader known as an Entry Port Stand-Alone Reader manufactured by HID Corporation having a capability or reading a chip contained in a proximity card having twenty six (26) or more bits of information coded therein with a range of approximately three (3) inches is preferred for, respectively, the reader module 12 and the receiver unit 14 chip 16. Accordingly, for the discussion of the reader module and receiver unit of the embodiments of FIGS. 1, 3, 4 and 5, the above identified Entry Port Stand-Alone Reader is preferred.

While in FIG. 1 the reader module 12 is positioned so as to be near to the cart mounted receiver unit 14 when an interrogation is commanded. It should, however, be understood, that the cart 11 mounted receiver unit 14 can be interrogated by a higher power and longer range reader module 12 that is located apart from a cart return area, such as at or near an establishment exit or entrance for sensing, by interrogating carts traveling out of the establishment, and connected to pass information to a computer, micro processor, or the like, for keeping track of cart as have been removed from the store for inventory control. For which arrangement, the same reader module 14 is preferably used, by a greater power of reader module 12 than the proximity reader module described above, would be required. Which variation in reader modules, it should be understood, are within the scope of this disclosure. The reader module 12, is shown in FIGS. 1, 3, 4 and 5, is accordingly either located so as to be in close proximity to the receiver unit 14 mounted to a cart 11 passed closely across the sensors 13*a* and 13*b* where a radio frequency (RF) interrogation takes place, or the reader module 12 can be spaced apart there from provided it has sufficient power to effect a remote interrogation. Further, the reader module 12 can arranged for remote operation as from a vehicle search for lost or stolen carts 11 removed form the establishment premises to interrogate the cart receiver unit 14 receiving a signal back from the receiver unit to activate an alarm on the remote reader module. Further, the receiver unit 14 upon receipt of an RF interrogation can be arranged to respond by an activation of a flashing light 16*a*, sound device 16*b*, or the like, shown in broken lines in FIG. 2, to a reader module 12 configured as a cart locator.

An advantage of the radio frequency interrogation of the receiver unit 14 by the reader module 12 is that, for most applications the receiver unit does not require a power source, such as a battery. However, where the receiver unit is a significant distance from the reader module, for example where the cart is being searched for and it is desired that the receiver unit 14 respond to an interrogation, then a power source, such as a battery 16*c*, shown in broken lines in FIG. 2, or like power source, may be connected to the chip 16 circuit and contained in the placard. Further, such battery can be provided to provide power to the light 16*a* and alarm 16*b*. Also, the reader module 12 sensors 13*a* and 13*b* can be arranged as a portable unit for ease of transport and could include a monitor to show an interrogation response from the receiver unit 14. Which inclusions and capabilities, it should be understood, are within the scope of this disclosure.

In practice, for the remote reader module 12 of FIG. 1, sensing travel of a cart 11 by the sensors 13*a* and 13*b*, to record the car across the sensor as a legitimate cart return and authorize a reward, as set out below, requires that cart travel must first be by sensor 13*a*, identified as 1, followed by passage by sensor 13*b*, identified as 2. Should a cart 11 be pulled back across the scanners, first passing sensor 13*b* followed by passage across sensor 13*a*, such will not be sensed as a legitimate cart return so as to qualify for a reward. Further, to avoid or preclude counting carts returned by a store employee as legitimate patron cart returns, the system preferably includes an employee deactivation component. For example, each employee can have their own identification card with each card, like the receiver unit 14, containing a chip to be read and interpreted by the reader module with the control interface 25 then interpreting the employee card information and passing same to the computer or micro processor. Alternative, the employee card can include an electronic strip identifying the card holder as an employee. Which card, when the employee pushes a return a cart through the sensors 13*a* and 13*b* is to be inserted into an employee reader slot 21 of the reader module 12 that both blocks issuance of a cart return reward and provides a running total of the number of carts as are returned by that employee.

Shown in FIG. 1, the remote reader module 12 is linked by electrical cable 19, shown in broken lines, to a control and reward module 23 that includes a housing 24, shown as being floor mounted, and includes a control interface module 25 that is connected by the cable 19 to the reader module 12. Further, a power source 26, shown herein as an interface or plug connection to a one hundred twenty (120) volt power outlet, is connected through wires 26*a* to the interface module 25 and through wires 26*b* to a communications interface module 27. The communications interface module 27 is, in turn, connected through wires 27*a* to a computer 28 or through wire 27*b* to a modem 29 for communicating with a remote computer, not shown. Which communications interface preferably includes a memory log of cart activity: for maintaining an individual cart use history for use in planning cart servicing; for providing a running total of carts remaining on the lot; for providing a running total of carts as are actually in use; for providing an analysis of cart use at different times of the day and night; for providing a merchant alert when a cart has not been returned; and for providing a running total of carts as are returned by each employee during their individual work shift.

Shown in FIG. 1, the control interface module 25 is also connected through wires 25*a* to patron reward module, herein identified as a ticket dispenser 30. Alternatively, as shown in broken lines in FIG. 1, the control interface module 25 may be connected through wire 25*b* to a random selection apparatus 30*a* that, in turn, connects through wire 25*c* to the patron reward module. The random selection apparatus 30*a* provides a circuit where an entering signal will be selectively passed or not passed therethrough to travel to the patron reward module, shown as ticket dispenser 30. So arranged, a reward will be randomly awarded to a patron returning a cart, as set out above. The ticket dispenser, upon receipt of a notification of a legitimate cart 11 return to a designated return area, and if enabled by the random selection apparatus 30*a*, issues a patron a ticket that can itself have value; represent a store discount coupon; a ticket for a drawing, such as a local or national lottery; have scratch off spaces to provide, when a winning symbol is present under the scratched off portion, an instant winner of cash, prize, or the like; or other reward as the store wishes to give its patrons for their cart return. To help in alerting patrons to the cart return system, the control and reward center module 23 are each shown as including a sign 44, or other display prominently thereon.

FIG. 2 shows a cart that includes the receiver unit 14 mounted thereon that incorporates the placard 15 with the embedded chip 16 and further shows, in broken lines, light 16*a*, a sound generating device 16*b*, shown as a horn, and battery 16*c*. The placard 15, it should be understood, can be fixed to either side of the shopping cart 11, depending on which side thereof is to pass across the reader module 12 sensors 13*a* and 13*a*, as discussed above.

Figure 3:
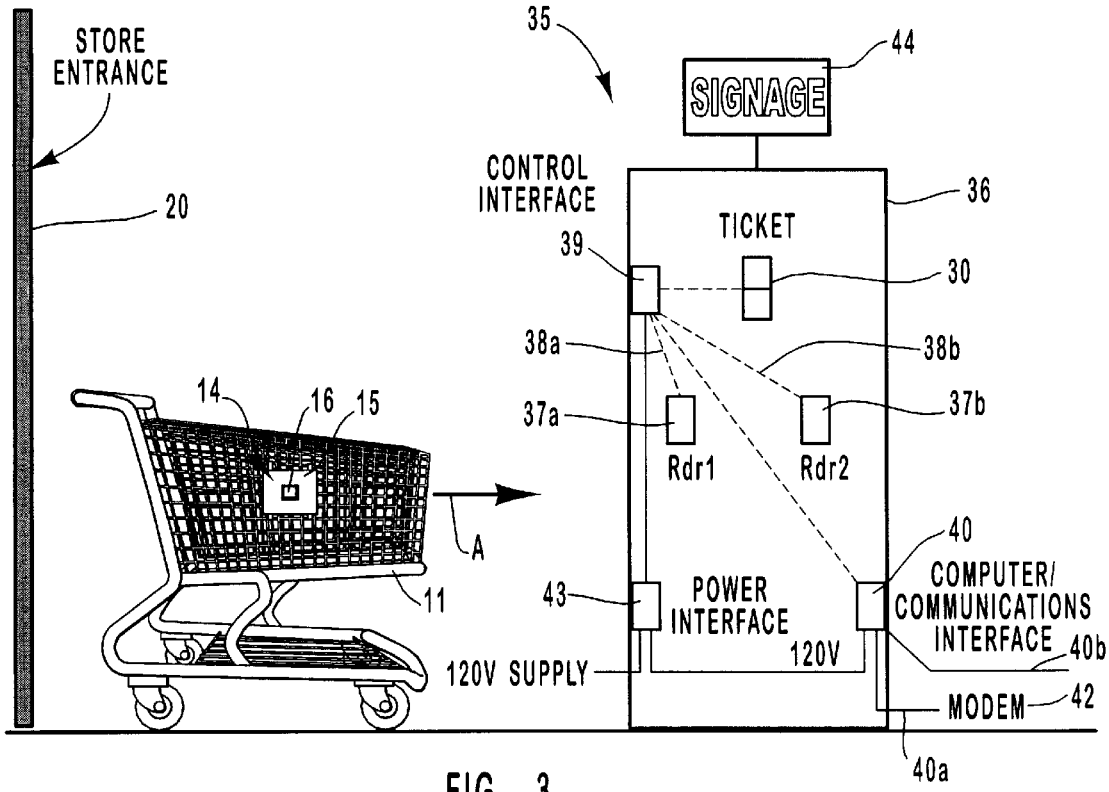
FIG. 3 is a profile schematic view of a shopping cart whereto is mounted the placard of FIG. 2 aligned to travel through a stand alone shopping cart detection system of the invention that includes a reader unit, power source, and a control interface that is connected to both a computer interface and modem to pass cart data thereto, and to a ticket dispenser of a patron reward system.

FIG. 3 shows, as a second embodiment of the invention, a stand alone shopping cart detection system 35, that is contained within a single housing 36 and is preferably located within a store, illustrated by wall 20 identified as a store entrance that can be any establishment that uses shopping type carts. The shopping cart detection system 35, like the detection system 10 of FIG. 1, includes a pair of first and second senior 37*a* and 37*b*, identified, respectively, as Rdr 1 and Rdr 2, that connect through lines 3*a* and 3*b* to a control interface 39, with the first and second sensor 37*a* and 37*b* to read the cart mounted receiver unit 14 contained in placard 15 that is the embedded chip 16, as described above with respect to FIG. 2. Like the sensors 13*a* and 13*b* of FIG. 1, the first and second sensors 38*a* and 38*b* will indicate a legitimate cart 11 return when the cart, traveling parallel to the sensors, first crosses sensor 38*a*, followed by a crossing of sensor 39*b*. Further, to this detection system 35, the first and second sensors 37*a* and 37*b* pass information to the control interface that receives power from a power source. The information passed from the sensors travels to an interface module 40 that is linked by a wire 40*a* to pass information to a modem 42 as well as to a computer/communication interface 40*b*. Further, like the detection system 10, the detection system 35 includes a timer circuit that is preferably employed within the control interfaces of the embodiments that may be set at a significant period of time, for example ten (10) minutes, that must be timed out before a cart 11, as identified by reading chip 16, can be recorded as legitimately being return. The timer circuit is to discourage a person from circling from exit to entrance to receive unearned rewards. Such timer arrangement, as set out above, can be in addition to other system safeguards to prohibit or at least inhibit an issuance of an unearned patron reward such as, but not limited to, a computer program that will alert the store if things such as redundant cart use, or the like, occur, allowing store personnel to check into the matter.

FIGS. 4 and 5 show another embodiment of the invention in a shopping cart detection system 50 that is arranged for use in a parking lot, or the like, and is positioned adjacent to a movable cart return cage 51. Which cart return cage 51 may, but does not necessarily include, a bar lock, not shown, or other locking device, to prohibit carts 11 from being pulled back out of the cage after passage therein, and is arranged to require an authorized store employee to remove carts from the cage, avoiding issuance of an unwarranted patron reward. Such cart return cage 51, as shown, can include a sign or signs 52 and 53, or the like, to both inform a patron where carts can be returned to receive a reward ticket, and to advertise the system.

The shopping cart detection system 50 includes a housing 54 mounted on wheels or rollers 55 so as to be portable, and is attachable onto the cart return cage 51 by a locking mechanism 56, that is preferrably a key operated lock. Within the housing 54, positioned on a floor 57 thereof, is shown a battery 58 having terminals 59*a* and 59*b* that are connected by battery cables 60*a* and 60*b* to a power interface unit 61. Providing the components of the cart detection system 50 are operated on standard AC voltage and current, the power interface unit 61 will provided for converting the low voltage high amperage direct current produced by the battery 58 into an appropriate AC voltage and current suitable for operating the system components. The interface unit 61 of the invention is an electronic circuit that provides power to a controller 62 through line 61 a, shown in broken lines, and receives a charging power feed from that controller through the same line 61 a when the battery is on a charging mode. Which charging power is provided to the controller 62 through a line 65*a*, shown as a broken line, from a solar panel 65 that, as shown, is preferably mounted onto a top 57*a* of the housing 54. The power interface unit 61 is connected also, though line 61*b* to a ticket dispenser 70, to operate a ticket fed mechanism to feed a first ticket off of a roll of tickets 71, which tickets may be arranged as a stack, with the selected ticket to pass through a slot 72 in a forward wall 54*a* of the housing 54. Which ticket dispenser 70 may, and preferably does, include a roll or stack sensor, shown as an arm 73, that is mounted at a pivot end 74 to be biased, shown as arrow B, against a top surface of the roll of tickets 71. So arranged, when the arm descends to a set angle from the horizontal, a sensing that the dispenser 70 is out of tickets 71 is sent to the control interface 62 and to a controller, shown as remote computer 67, indicating that the roll of tickets 71 should be replaced.

The individual ticket 71 may have scratch off spaces that expose a combination of letters, numbers, words, or the like, that constitute an instant winner, or may be for a drawing, either a local drawing or national drawing, such as a lotto; may be a discount coupon, or the like. Which tickets 71 are both given as rewards for cart returns and to encourage a patron to return to the establishment and shop again.

The reader module sensor 63*a* shown in FIG. 4, and the reader module sensors 63*a* and 63*b*, as shown in FIGS. 4 and 5, are like, and should be understood, are to function like the sensors 13*a* and 13*b*, shown in FIG. 1 and like sensor 37*a* and 37*b*, shown in FIG. 3, The sensors, 63*a* and 63*b* of FIGS. 4 and 5, are to indicate cart passage there across through line 63*c* to the control unit 62 that, in turn, both stores that information and sends it through line 64*a* to an antenna module 64. The antenna passes the received cart data through line 67*a* to a separate computer 67, or micro processor that receives the data through an antenna 68, and processes that data, as set out above. Alternatively, the data from control unit 62 can be transmitted through a modem, like the modem 42 shown in FIGS. 1 and 3, for transmission to another or separate computer or micro processor for data tabulation with the data received from a number of shopping cart detection systems, within the scope of this disclosure.

Hereinabove have been shown and described preferred embodiment of shopping cart detection apparatus and a reward system associated therewith of my invention. It should, however, be understood that the present disclosure is made by way of example only and that variations are possible without departing from the subject matter coming within the scope of the following claims and a reasonable equivalency thereof, which subject matter I regard as my invention.

I claim:

1. A shopping cart detection apparatus and a reward system associated therewith comprising, a housing for location adjacent to a designated cart return area containing a power supply linked to a control interface unit that connects to both a reward dispenser and a communications interface module, which control interface unit connects to a reader module that includes a pair of in-line first and second cart sensors that individually sense passage of a cart traveling past each said sensor into a cart collection area or cage indicating cart direction of travel, and said control interface unit provides a radio frequency interrogation of a receiver unit that is mounted onto said cart to collect data received from said reader module and to verify that said cart has properly passed said sensor or sensors, whereupon said control interface commands operation of said reward dispenser to dispense a patron reward, and passes a record of said cart return to a communication interface that is linked to a computer or micro processor; and an adjustable timer or timer circuit connected to said control interface that is actived and begins counting down for a set period of time upon receipt of the transmission from said receiver unit, which said timer must time out prior to sending the signal to activate said reward dispenser to issue a patron reward.

2. A shopping cart detection apparatus and reward system associated therewith as recited in claim 1, wherein the reader module is separately housed from the control interface and is linked thereto through an electrical transmission cable.

3. A shopping cart detection apparatus and reward system associated therewith as recited in claim 1, wherein the control interface interrogates the receiver unit with a radio frequency signal that the receiver unit responds to by transmitting its designation and other information as is programmed therein, which said receiver unit is a chip and is contained within a placard for attachment onto a cart side.

4. A shopping cart detection apparatus and reward system associated therewith as recited in claim 3, wherein the chip is fitted into a flat plate that is mounted to the shopping cart, and said chip is arranged to respond to receipt of a radio frequency transmission from the control interface.

5. A shopping dart detection apparatus and reward system associated therewith as recited in claim 1, further including an employee deactivation component that includes an employee proximity card having an electronic chip that will respond to radio frequency interrogation and transmit employee information coded therein.

6. A shopping cart detection apparatus and reward system associated therewith as recited in claim 5, wherein the communications interface connects directly to a computer or micro processor or connects through a modem linked to a remote computer or micro processor to pass information regarding cart returns and rewards issued to patrons and to identify employee cart returns, which information can be used in monitoring individual cart use and employee productivity.

7. A shopping cart detection apparatus and reward system associated therewith as recited in claim 5, wherein the communications interface is arranged to transmit data through an antenna to be received by an antenna and receiver of a remote computer or micro processor to pass information regarding cart returns and rewards issued to patrons and to identify employee cart returns, which information can be used in monitoring individual cart use and employee productivity.

8. A shopping cart detection apparatus and reward system associated therewith as recited in claim 1, wherein the reward dispenser is a ticket dispenser that includes a sensor for determining when a roll or stack of tickets is nearing its end and indicating which low ticket condition to the control interface that relays this information through the communications interface to alert store personnel that a replacement ticket roll or stack is needed.

9. A shopping cart detection apparatus and reward system associated therewith as recited in claim 1, further including a sign or signs maintained on the housing and/or cart collection area or cage.

10. A shopping cart detection apparatus and reward system associated therewith as recited in claim 1, wherein the power supply is a solar panel linked to a battery and arranged to charge said battery that is, in turn, connected to the control interface unit.

11. A shopping cart detection apparatus and reward system associated therewith as recited in claim 1, wherein the housing is a portable unit.

12. A shopping cart detection apparatus and reward system associated therewith as recited in claim 1, further including a high power control interface unit and reader module assembly for installation apart from a cart return area or cage to interrogate a cart mounted receiver unit as said cart leaves the store for comparison with cart return data for use in cart inventory control.

13. A shopping cart detection apparatus and reward system associated therewith as recited in claim 1, wherein the patron reward can be determined by operation of a random selection apparatus linked to the reward dispenser.

14. A shopping cart detection apparatus and a reward system associated therewith comprising, a housing for location adjacent to a designated cart return area containing a power supply linked to a control interface unit that connects to both a reward dispenser and a communications interface module, which control interface unit connects to a reader module that includes a pair of in-line first and second cart sensors that individually sense passage of a cart traveling past each said sensor into a cart collection area or cage indicating cart direction of travel, and said control interface unit provides a radio frequency interrogation of a receiver unit that is mounted onto said cart to collect data received from said reader module and to verify that said cart has properly passed said sensor or sensors, whereupon said control interface commands operation of said reward dispenser to dispense a patron reward, and passes a record of said cart return to a communication interface that is linked to a computer or micro processor; and an employee detection component that includes an employee proximity card having an electronic chip that will response to a radio frequency interrogation and transmit employee information coded therein to said computer or micro processor.

15. A shopping cart detection apparatus and reward system associated therewith as recited in claim 14, wherein the communications interface connects directly to a computer or micro processor or connects through a modem linked to a remote computer or micro processor to pass information regarding cart returns and rewards issued to patrons and to identify employee cart returns, which information can be used in monitoring individual cart use and employee productivity.

16. A shopping cart detection apparatus and reward system associated therewith as recited in claim 14, wherein the communications interface is arranged to transmit data through an antenna to be received by an antenna and receiver of a remote computer or micro processor to pass information regarding cart returns and rewards issued to patrons and to identify employee cart returns, which information can be used in monitoring individual cart use and employee productivity.

17. A shopping cart detection apparatus and reward system associated therewith as recited in claim 14, wherein the power supply is a solar panel linked to a battery and arranged to charge said battery that is, in turn, connected to the control interface unit.

18. A shopping cart detection apparatus and reward system associated therewith as recited in claim 14, wherein the housing is a portable unit.

19. A shopping cart detection apparatus and a reward system associated therewith comprising, a housing for location adjacent to a designated cart return area containing a power supply linked to a control interface unit that connects to both a reward dispenser and a communications interface module, which control interface unit connects to a reader module that includes a pair of in-line first and second cart sensors that individually sense passage of a cart traveling past each said sensor into a cart collection area or cage indicating cart direction of travel, and said control interface unit provides a radio frequency interrogation of a receiver unit that is mounted onto said cart to collect data received from said reader module and to verify that said cart has properly passed said sensor or sensors, whereupon said control interface commands operation of said reward dispenser to dispense a patron reward, and passes a record of said cart return to a communication interface that is linked to a computer or micro processor; and a high power control interface unit and reader module assembly for installation apart from said cart return area or cage to interrogate a cart mounted receiver unit as said cart leaves the store for comparison with cart return data for use in cart inventory control.

* * * * *